US006290144B1

(12) United States Patent
Maxwell

(10) Patent No.: US 6,290,144 B1
(45) Date of Patent: Sep. 18, 2001

(54) DECORATIVE WATERFALL SYSTEM

(76) Inventor: Douglas Tyson Maxwell, P.O. Box 4865, Boulder, CO (US) 80306-4865

( * ) Notice: Subject to any disclaimer, the term of this patent is extended or adjusted under 35 U.S.C. 154(b) by 0 days.

(21) Appl. No.: 09/610,236

(22) Filed: Jul. 5, 2000

(51) Int. Cl.[7] ..... B05B 17/08
(52) U.S. Cl. ..... 239/20; 239/17
(58) Field of Search ..... 239/16, 17, 18, 239/20, 211; D23/201; 40/406

(56) References Cited

U.S. PATENT DOCUMENTS

D. 378,120 * 2/1997 Wood ..... D23/201
D. 378,773 * 4/1997 Wood ..... D23/201
4,217,315 * 8/1980 Keeler, II ..... 239/17 X
5,501,178 * 3/1996 Kemp ..... 239/17 X

* cited by examiner

*Primary Examiner*—Lesley D. Morris
(74) *Attorney, Agent, or Firm*—Lathrop & Gage L.C.; Dan Cleveland

(57) ABSTRACT

A waterfall system is provided. The waterfall system has a reservoir tank for holding water and a pump mechanism within the reservoir tank for pumping the water. A conduit cooperates with the pump means and has a first end and a second end for directing the pumped water from the first end of the conduit means to the second end of the conduit means with the first end of the conduit means being positioned within the reservoir tank. A spiral directional mechanism on the conduit means directs the pumped water substantially from the second end of the conduit means in a continuous spiral manner in a direction generally toward the first end.

31 Claims, 3 Drawing Sheets

DECORATIVE WATERFALL SYSTEM

BACKGROUND OF THE INVENTION

1. Field of the Invention

This invention relates generally to a decorative waterfall, and, more particularly, it relates to a decorative waterfall system which has the ability to alter the flow of the water down the waterfall for an unlimited aesthetic effect.

2. Description of the Prior Art

Table top fountains and larger monumental fountains are increasingly appearing in homes, offices, shopping malls, airports, public parks, and civic areas providing an aesthetically pleasing visual and audible effect to help people relax in the busy and high stress daily environment. Most waterfalls, however, are bulky, have a limited number of embodiments, have a large footprint with exposed bowl or pool, are expensive and have excessive amounts of splashing caused by the water failing outside the perimeter of the bowl or pool during the fall. Excessive splashing is a problem in both private and public applications because of large damage to indoor furniture and equipment and safety problems such as slip and fall accidents.

Furthermore, many waterfalls have a fixed water flow down the waterfall which can not be rearranged and/or otherwise altered by the user to change the visual or auditory effects of the water flow. For instance, the Hibben, U.S. Pat. No. D213,692, and the Hibben, U.S. Pat. No. D213,693, provide a fountain having a variety of water flow changing elements for providing a variety of water pools and an aesthetically pleasing waterfall effect. Unfortunately, however, the water flow changing elements of the Hibben patents can not be rearranged, removed, and/or otherwise altered to change the aesthetic effect of the water flow down the waterfall. After a certain amount of time, a user can become bored with the waterfall and the aesthetically pleasing and mood soothing effects on the user can be compromised.

Accordingly, there exists a need for a decorative waterfall system which provides an inexpensive waterfall system. Additionally, a need exists for a decorative waterfall system which provides a user the opportunity to alter the flow of water down the waterfall for an unlimited variety of visual and auditory effects. Additionally there exists a need for a decorative waterfall system which has a plurality of removable water flow changing elements which can be added and removed to alter the flow of water down the waterfall. Additionally there exists a need for a decorative waterfall which allows control on the size of the pool exposed to the surface. Furthermore there exists a need for a decorative waterfall system with an unlimited variety of embodiments.

SUMMARY

The present invention is a waterfall system comprising a reservoir tank for holding water and pump means within the reservoir tank for pumping the water. Conduit means cooperates with the pump means and has a first end and a second end for directing the pumped water from the first end of the conduit means to the second end of the conduit means with the first end of the conduit means being positioned within the reservoir tank. At least one spiral directional means on the conduit means directs the pumped water from the second end of the conduit means in a continuous spiral manner in a direction generally toward the first end.

The present invention further includes a decorative water feature system having a water reservoir for holding water and a pump for pumping water from the water reservoir. The decorative water feature system comprises a conduit having a first end and a second end with the pump pumping the water from the first end to the second end. At least one continuous spiral vane extends substantially from the second end to the first end and at least one removable water diverting element releasably secured within the spiral vane for diverting water from the spiral vane as the water travels down the continuous spiral vane substantially toward the first end of the conduit.

The present invention still further includes a method for creating a decorative waterfall. The method comprises providing a reservoir tank, filling the reservoir tank with water, providing a pump, providing a conduit having at least one continuous spiral vane extending substantially along the length of the conduit, pumping the water from the reservoir tank and through the conduit with the water traveling along the spiral vane into the reservoir tank.

DETAILED DESCRIPTION OF THE PREFERRED EMBODIMENTS

Figure 1:
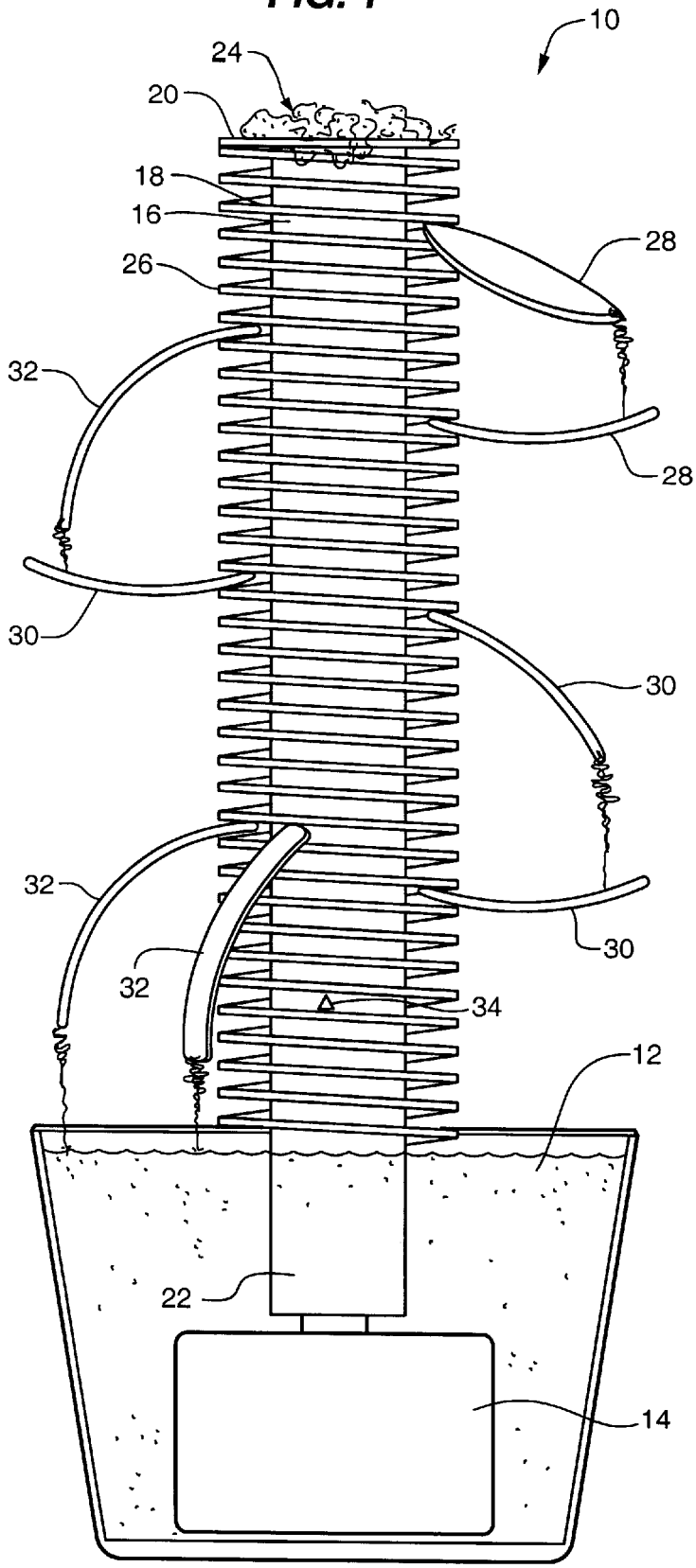
FIG. 1 is a side elevational view illustrating a decorative waterfall system, constructed in accordance with the present invention, with removable elements releasably secured thereto for altering the flow of the water down the waterfall system.
Figure 2:
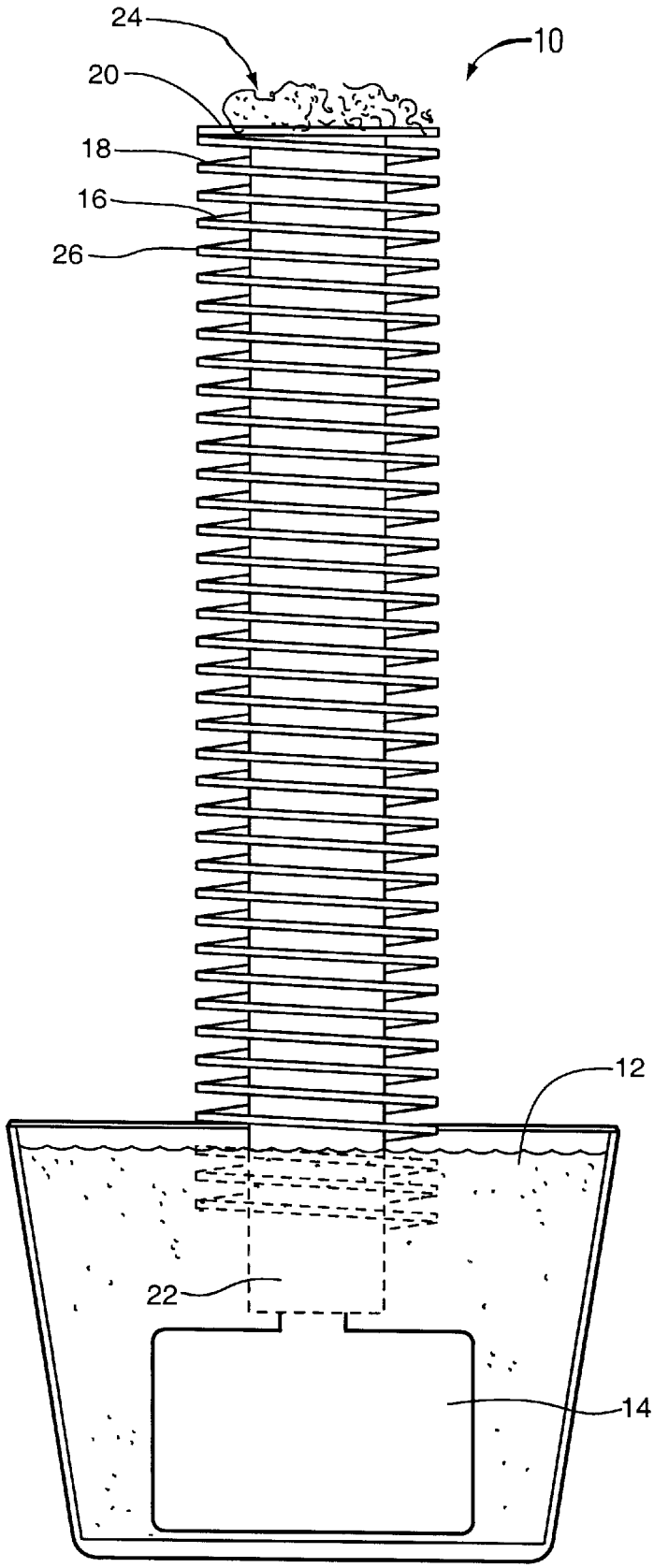
FIG. 2 is another side elevational illustrating the decorative waterfall system, constructed in accordance with the present invention.
Figure 3:
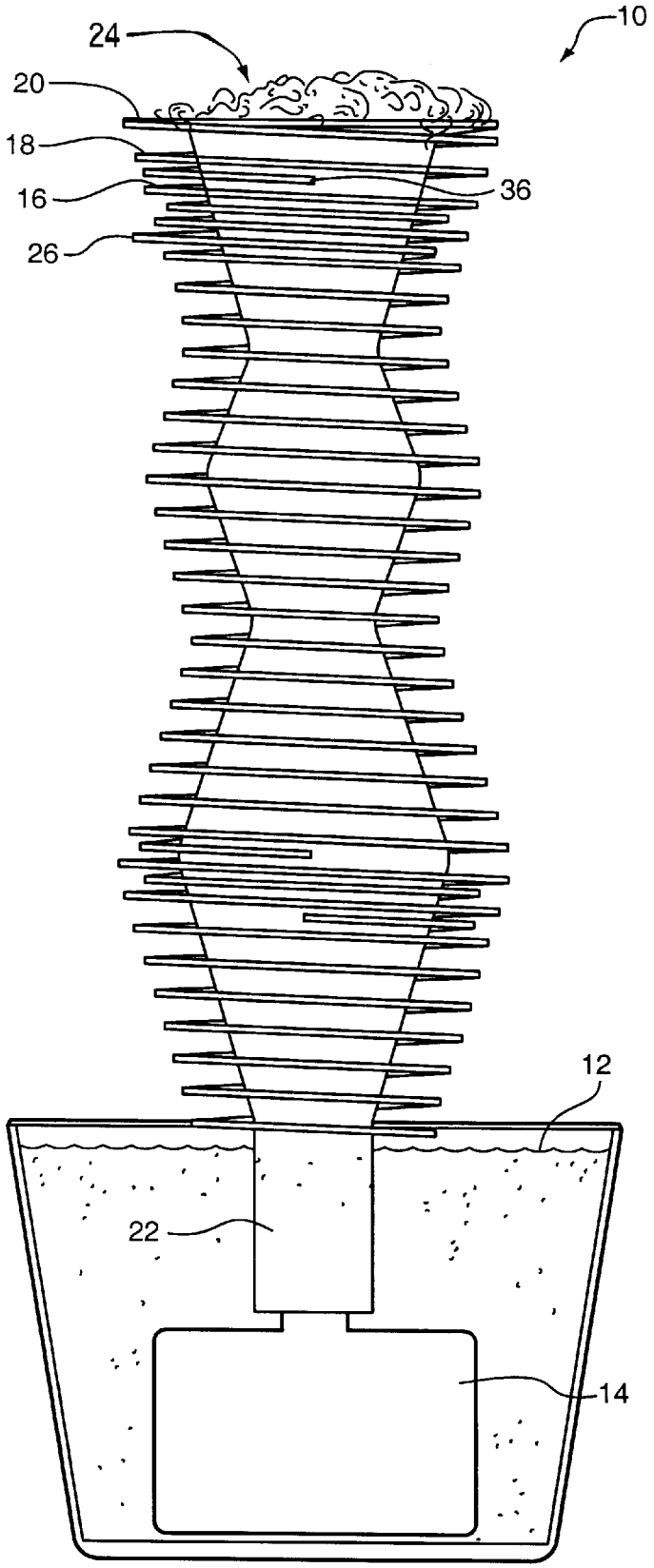
FIG. 3 is a side elevational view illustrating another embodiment of the decorative waterfall system, constructed in accordance with the present invention; and illustrating the furcating spiral vanes.

As illustrated in FIGS. 1, 2, and 3, the present invention is a decorative waterfall or fountain system, indicated generally at 10, for creating a decorative water feature for use indoors and outdoors, depending on the desires of the user. The decorative waterfall system 10 of the present invention includes a water reservoir 12, a pump 14, and a hollow conduit 16. The water reservoir 12 can be any type of basin or tank which allows a sufficient amount of water to pool within the water reservoir 12. Furthermore, the pump 14 is preferably a small submersible pump typically of the type used for garden ponds and waterfalls and is positioned within the water reservoir 12 such that the pump 14 can pump and recirculate the water collected within the water reservoir 12, as will be described in further detail below.

As illustrated in FIGS. 1 and 2, the conduit 16 can have a substantially cylindrical shape and configuration, or, as illustrated in FIGS. 3, the conduit can have other types of shapes and configurations. In both instances, the conduit has an outer surface 18, an inner surface 20, a first end 22, and a second end 24 substantially opposite the first end 22.

Additionally, the conduit 16 has at least one continuous, spaced spiral vane 26 fixed on the outer surface 18 of the conduit 16 forming in a continuously spiral configuration substantially from the second end 24 of the conduit 16 to substantially the first end 22 of the conduit 16. Preferably, the spiral vane 26 has a depth of approximately 0.4 inch and a spacing of approximately 0.15 inch. It is within the scope of the present invention, however, to have a spiral vane 26 having a depth greater than or less than approximately 0.4 inch and a spacing of greater than or less than approximately 0.15 inch. The spacing and depth of the spiral vane 26 is dependent upon the desire of the user, the size and shape of the embodiments, the number of spiral vanes, and upon the size and shape of any removable elements inserted therein, as further discussed below.

The spiral vane 26 can be welded on the outer surface 18 of the conduit 16 or formed on the outer surface 18 of the conduit 16 during manufacturing and construction of the conduit 16, such as with a heat exchange conduit. While certain methods of mounting and forming the spiral vane 26 on the outer surface 18 of the conduit 16 have been described, a person skilled in the art will understand that it is within the scope of the present invention to mount or form the spiral vane 26 on the outer surface 18 of the conduit 16 by any method or in any manner.

In use, the first end 22 of the conduit 16 is positioned in the water reservoir 12 in pumping cooperation with the pump 14 such that the pump 14 causes water within the water reservoir 12 to enter the first end 22 of the conduit 16 which is pumped in a generally upward direction through the conduit 16 toward the second end 24, and flows substantially from the second end 24 of the conduit 16. The water then flows down the outer surface 18 of the conduit 16 in a spiral manner on the spiral vane 26 mounted to the outer surface 18 of the conduit 16 and substantially into the water reservoir 12 for continual pumping of the water back through the conduit 16 by the pump 14.

A briefly mentioned above, in an embodiment of the present invention, the decorative waterfall system 10 of the present invention further includes at least one removable element 28 releasably securable between the spiral vanes 26. The removable elements 28 can include a variety of shapes and designs to cause the water traveling down the spiral vanes 26 to pool and/or exit the spiral vanes 26 in a desired, and sometimes unpredictable, manner. In an embodiment of the present invention, the removable elements 28 can include a variety of removable elements 28 including, but not limited to, concave removable elements 30 which cause the water to pool therein, rounded removable elements 32 which cause the water to exit the spiral vane 26 and fall toward the water reservoir 12 and removable riffle elements 34 which cause the water to begin turbulent flow.

In use of the decorative waterfall system 10 of the present invention, with the concave removable elements 30 releasably mounted with the spiral vanes 26, for example, upon the water level within the concave removable element 30 reaching a predetermined level, the excess water will leave the concave removable element 30 to continue travel down the spiral vanes 26 or spill in a generally outward direction to fall into another concave removable element 30 located below (see FIG. 1) to create steady state flowing reservoirs, fall onto a different type of removable element 28 located below, or fall into the water reservoir 12 located below. In use of the decorative waterfall system 10 of the present invention, with the rounded removable elements 32 releasably mounted within the spiral vane 26, water traveling down the spiral vane 26 substantially from the second end 24 of the conduit 16 will immediately exit the spiral vanes 26 and fall downward onto another removable element 28 and/or substantially into the water reservoir 12 located below. In use of the decorative waterfall system 10 of the present invention, with the removable riffle 34 releasably mounted with the spiral vanes 26, water traveling down the spiral vane 26 substantially from the second end 24 of the conduit 16 will upon reaching the riffle 34 will become turbulent.

As mentioned briefly above the spiral vane 26 may furcate into a plurality of vanes 36 which may originate and terminate anywhere along the conduit 16 and/or exit the conduit 16 and terminate and/or continue as a spiral vane on a contiguous, adjacent, or distal embodiment.

It should be noted that the amount of water pumped through the conduit 16 by the pump 14 from the water within the water reservoir 12 can be adjusted such that the proper and desired amount of water exits the second end 24 of the conduit 16. For instance, the user can adjust the amount of water such that only that amount of water sufficient to travel on top of the spiral vane 26 downward to the water reservoir 12 is released from the second end 24 of the conduit 16. Likewise, to create both the spiral effect on top of the spiral vane 26 and a free flowing effect over the edge of the spiral vane 26 directly into the water reservoir 12 below, the amount of water can be adjusted to emit a larger volume of water from the second end 24 of the conduit 16.

The decorative waterfall system 10 of the present invention provides a compact or larger, inexpensive waterfall system for use in the home, office and/or in other private and public environments. The decorative waterfall system 10 of the present invention further provides a user the opportunity to alter the flow of water down the waterfall for an unlimited variety of visual and sound effects by providing a plurality of removable water flow changing elements 28 which can be added and removed from between the spiral vane 26 to physically and visually alter the flow of water down the decorative waterfall system 10.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. An interactive water fall system comprising:

reservoir means for containing a body of water;

conduit means in cooperation with said reservoir means, with at least one spiral directional means formed on said conduit means;

at least one removable flow altering element releasably secured with respect to said at least one spiral directional means formed on said conduit means; and a water source for providing water to the top of said conduit means whereupon water flows down said conduit means under the influence of gravity, encountering said at least one flow altering element which causes the water to cascade outward, collect in a pool or produce turbulent flow.

2. The interactive waterfall system of claim 1 wherein the conduit means has any shape that can be circumscribed along any of its area by said at least one spiral directional means.

3. The interactive waterfall system of claim 1 wherein said at least one spiral directional means comprises at least one continuous spiral vane extending substantially from of the helical means second end of the helical means to of the helical means first end of the helical means.

4. The interactive waterfall system of claim 1 wherein the conduit means is distal but in pumping cooperation with the reservoir means.

5. The interactive waterfall system of claim 1 wherein said conduit means is positioned within the reservoir in pumping cooperation with the water source.

6. The interactive waterfall system of claim 1 wherein said water source for providing water to the top of said conduit means comprises a pump having a suction side drawing from said reservoir means and a discharge side in cooperation with the top of the conduit means.

7. The interactive waterfall system of claim 1 wherein the water exits a discharge side of water source and enters a first end of said conduit means through an internal passageway extending in a generally upward direction to a second end of the helical means.

8. The interactive waterfall system of claim 1 wherein said at least one spiral directional means formed on said conduit means comprises furcating vanes.

9. The interactive waterfall system of claim 1 wherein said conduit means has more than one spiral directional means each contain at least one flow altering element adequate for discharging water.

10. The interactive water feature of claim 1 wherein said at least one removable, flow altering element has a substantially concave shape allowing pooling of said at least one water within the removable flow altering element.

11. The interactive water feature of claim 1 wherein said at least one removable, flow altering element has a substantially rounded shape for diverting water from said at least one flow altering removable element.

12. The interactive water feature system of claim 1 wherein said at least one removable flow altering element is comprised of a turbulent flow producing piece.

13. A waterfall system, comprising:

a reservoir for holding water;

a pump for pumping the water;

a conduit cooperating with the pump and having a first end and a second end for directing the pumped water from the first end of the conduit to the second end of the conduit, the first end of the conduit being positioned within the reservoir tank;

at least one spiral directional means on the conduit for directing the pumped water from the second end of the conduit in a continuous spiral manner in a direction generally toward the first end; and at least one removable element releasably mounted within the spiral directional means for altering the water flow from the second end of the conduit substantially to the first end of the conduit.

14. The waterfall system of claim 13 wherein the pump is a submersible pump.

15. The waterfall system of claim 13 wherein the conduit has any shape that can be circumscribed along any of its area by at least one of the spiral directional means.

16. The waterfall system of claim 13 wherein the spiral directional means comprises at least one continuous spiral vane extending substantially from the second end of the conduit substantially to the first end of the conduit.

17. The waterfall system of claim 13 wherein at least one of the removable elements has a substantially concave shape allowing pooling of the water within the removable element.

18. The waterfall system of claim 13 wherein at least one of the removable elements directs the water away from the spiral directional means in a general direction toward the reservoir tank.

19. The waterfall system of claim 13 wherein at least one of the removable elements is a turbulent flow producing riffle.

20. A decorative water feature system having a water reservoir for holding water and a pump for pumping water from the water reservoir, the decorative water feature system comprising:

a conduit having a first end and a second end, the pump pumping the water from the first end to the second end;

a continuous spiral vane extending substantially from the second end to the first end;

at least one removable water diverting element releasably secured within the spiral vane for diverting water from the spiral vane as the water travels down the continuous spiral vane toward the first end of the conduit.

21. The decorative water feature system of claim 20 wherein the pump is a submersible pump.

22. The decorative water feature system of claim 20 wherein the conduit has any shape which contains an area that can be circumscribed with a continuous spiral vane.

23. The decorative water feature system of claim 20 wherein at least one of the removable water diverting elements has a substantially concave shape allowing pooling of the water within the removable element.

24. The decorative water feature system of claim 20 wherein at least one of the removable water diverting elements has a substantially rounded shape for diverting water from the spiral vane.

25. The decorative water feature system of claim 20 wherein at least one of the removable water diverting elements is comprised of a turbulent flow producing riffle.

26. A method for creating a decorative waterfall, the method comprising:

providing a reservoir tank;

filling the reservoir tank with water;

providing a pump;

providing a conduit having at least one continuous spiral vane extending substantially along the length of the conduit;

pumping the water from the reservoir tank and through the conduit, the water traveling along the spiral vane into the reservoir tank; and inserting at least one removable element within the spiral vane for altering the water flow from the second end of the conduit means to the first end of the conduit means.

27. The method of claim 26 and further comprising providing the conduit with any shape which contains an area that can be circumscribed with a continuous spiral vane.

28. The method of claim 26 wherein the conduit has a first end and a second end, and further comprising extending the spiral vane substantially from the second end of the conduit to the first end of the conduit.

29. The method of claim 26 and further comprising providing at least one of the removable elements with a substantially concave shape.

30. The method of claim 26 and further comprising providing at least one of the removable elements with a substantially rounded shape.

31. The method of claim 26 and further comprising providing at least one of the removable elements with a turbulent flow producing riffle.

* * * * *

UNITED STATES PATENT AND TRADEMARK OFFICE

CERTIFICATE OF CORRECTION

PATENT NO. : 6,290,144 B1
APPLICATION NO. : 09/610236
DATED : July 19, 2005
INVENTOR(S) : Dennis Niermann It is certified that error appears in the above-identified patent and that said Letters Patent is hereby corrected as shown below:

Delete Claim 1 in its entirety and replace with the following

1. A method of routing Signaling System 7 (SS7) signaling traffic over an Internet Protocol (IP) network comprising the steps of:

a first signaling gateway (SG) receiving SS7 signaling traffic from a first signaling point;

converting said SS7 signaling traffic to an IP message stream utilizing protocol conversion layers, wherein said conversion layers include transaction capabilities application part (TCAP), message transfer part 1 (MTP1), MTP2, and MTP3 Message Transfer Part 3-User Adaptation Layer (M3UA) to a second signaling gateway, wherein "the second SG receiving the IP message stream and recovering the SS7 signaling traffic from the IP message stream and sending the recovered SS7 signaling traffic to a second SS7 signaling link;"

transferring the signaling traffic over the IP network by routing the signaling traffic in said IP message stream to a second SG capable of supporting peer-to-peer communications with the first SG; and the second SG receiving the IP message stream, recovering the SS7 signaling traffic from the IP message stream and sending the recovered SS7 signaling traffic to a second signaling point.

Signed and Sealed this

Twenty-first Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 6,290,144 B1
APPLICATION NO. : 09/610236
DATED : September 18, 2001
INVENTOR(S) : Douglas Tyson Maxwell It is certified that error appears in the above-identified patent and that said Letters Patent is hereby corrected as shown below:

This certificate supersedes Certificate of Correction issued November 21, 2006, should be vacated since no Certificate of Correction was granted for this patent number.

Signed and Sealed this

Ninth Day of January, 2007

JON W. DUDAS
*Director of the United States Patent and Trademark Office*